United States Patent [19]

Allemann et al.

[11] 4,109,496

[45] Aug. 29, 1978

[54] TRAPPED KEY MECHANISM

[75] Inventors: James G. Allemann, Santa Ana; Michael W. Grey, South Gate, both of Calif.

[73] Assignee: Norris Industries, South Gate, Calif.

[21] Appl. No.: 862,558

[22] Filed: Dec. 20, 1977

[51] Int. Cl.[2] ..... E05B 11/00

[52] U.S. Cl. ..... 70/380; 70/389; 70/DIG. 60

[58] Field of Search ..... 70/120, 134, 389, 390, 70/DIG. 60, 419, 421, 379 R, 380

[56] References Cited

U.S. PATENT DOCUMENTS

| | | | |
|---|---|---|---|
| 785,228 | 3/1905 | Phelps | 70/134 |
| 1,454,020 | 5/1923 | Teich | 70/120 |
| 3,938,358 | 2/1976 | Doyle | 70/421 |
| 4,028,917 | 6/1977 | Schlage | 70/389 |

*Primary Examiner*—Robert L. Wolfe

[57] ABSTRACT

A security type dead bolt for a door is arranged so that a key must be used on the inside, as well as on the outside, to extend the dead bolt to locked position, in that way to prevent an unauthorized person opening the door from the inside after surreptitious entry. To make certain that when the occupant is at home and with the latch bolt extended by the inside key to locked position, there can be no lost key situation blocking exit by the occupant in case of an emergency such as a fire, the dead bolt mechanism is arranged to trap the key in the lock whenever the dead bolt is extended to locked position, but to release the key when withdrawn. A yieldable mechanism permits unlocking the latch bolt from the outside even when a key is left in the lock on the inside.

8 Claims, 11 Drawing Figures

TRAPPED KEY MECHANISM

Dead bolt lock sets in current use which have been resorted to for the purpose of adding to the security against break-ins by unauthorized persons consist of a dead bolt mechanism manipulated on the outside by a key actuated mechanism and on the inside, in the alternative, by either a thumb turn or a keyed cylinder inner trim. A lock set provided with either a thumb turn or a keyed cylinder inner trim provides a high degree of security against break-ins. On the other hand, the thumb turn has a disadvantage in one area, and the key cylinder inner trim a disadvantage in another area.

For example, the thumb turn lock set will allow an intruder, once entry has been made by other means, to simply open the main entrance door by that expedient, permitting easy exit with large, bulky articles which could perhaps not be easily removed elsewhere.

The keyed cylinder inner trim, devoid of thumb turn and depending upon a key to be opened, effectively prevents an intruder from opening the main entrance door from the inside even after entry has been made by some other means. Hence, bulky articles are more difficult to remove.

The keyed cylinder inner trim, however, presents a safety hazard to the occupant. For example, in the event of fire, with the dead bolt mechanism extended to locked position and the key withdrawn and placed elsewhere, it is a very likely possibility that a panic situation would exist because of difficulty in finding the key under the stress of circumstances in order to unlock the door on the inside. Such a situation could result in disaster.

It is therefore among the objects of the invention to provide the security of a double cylindered dead locking bolt which has the convenience of a thumb turn on the inner trim, thereby making it possible for the occupant to exit under all conditions, but which preserves the security barring against exit by unauthorized persons when the occupant is not on the premises.

Another object of the invention is to provide a new and improved double cylindered dead locking bolt device of such construction that the key actuated mechanisms remain of substantially conventional construction, with only a modest modification being needed to trap the key in the lock when the locking bolt is extended to locked position by an occupant who remains inside.

Still another object of the invention is to provide a new and improved double cylindered dead locking bolt device which is compact, convenient and inexpensive, taking no more room in its place on the door than conventional double cylinder dead bolt devices.

Still further among the objects of the invention is to provide a new and improved double cylindered dead bolt device which can be readily manipulated from the outside by use of a key fitting the double cylinder lock assembly under circumstances where the inner key actuated mechanism has been manipulated and the key left in place.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

DESCRIPTION OF THE PREFERRED EMBODIMENT

Figure 1:
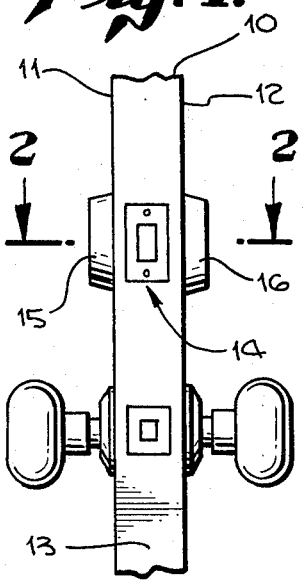
FIG. 1 is an edge elevational view of a section of door showing the dead bolt lock set mounted in place in conjunction with a conventional knob set.
Figure 2:
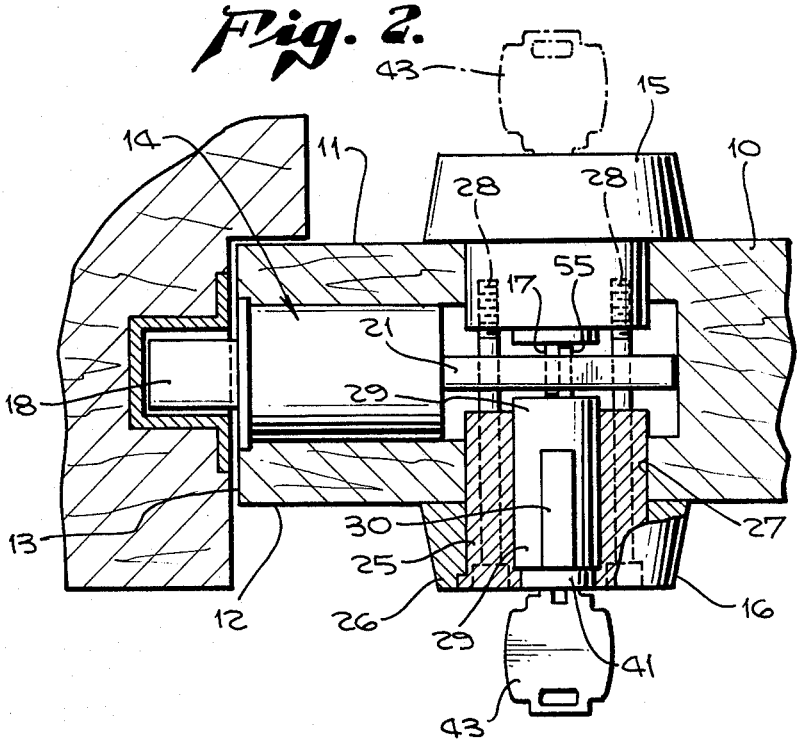
FIG. 2 is a cross-sectional view on the line 2—2 of FIG. 1.

In an embodiment of the invention which has been chosen for the purpose of illustration, the dead bolt lock set which incorporates the trapped key mechanism is shown mounted in a door 10, the door having an outer face 11 an inner face 12, and an edge face 13. The lock set in the main consists of a dead locking bolt assembly 14 which is manipulated from the outer face 11 by an outer trim assembly 15 and from the inner face by an inner trim assembly 16.

The outer trim assembly 15 is a substantially conventional key actuated mechanism, by means of which an outer tail piece 17 is rotated for the purpose of extending and withdrawing a locking bolt 18. The outer tail piece, of substantially rectangular cross-section, extends into a comparable portion 19 of an opening in a rotatably mounted hub 20. The hub 20 has a rotatable mounting in a housing 21 of the dead locking bolt assembly and is adapted to manipulate an appropriate conventional roll back mechanism by means of which rotational motion is converted to linear motion to extend and retract the locking bolt 18.

Details of the inner trim assembly 16 are shown, inasmuch as they contribute to an understanding of the trapped key mechanism comprising the invention. As shown in the drawings, a cylinder housing 25 is contained partially within a guard ring 26 and partially within a cross bore 27 in the door 10, which extends through the door to accommodate a corresponding portion of the outer trim assembly 15. Appropriate conventional bolts 28 interconnect the outer and inner trim assemblies, holding them in place on the door.

Within the cylinder housing 25 is a cylinder 29 having on one side a flange 30 for the accommodation of top pin tumblers 31 and bottom pin tumblers 32 driven by appropriate top pin springs 33, the pin tumblers being substantially conventional in form and operation in the respective pin tumbler bores 34.

Within the cylinder 29 is a cylinder plug 40 provided at its outer end with an annular flange 41, at the center of which is a keyway 42 for the accommodation of an appropriate conventional key 43. Appropriate cuts of the key 43 manipulate the respective bottom pin tumblers in the respective pin tumbler bores 44 of the cylinder plug 40 with respect to a sheer line 45 between the outer circumference of the cylinder plug 40 and the inner circumference of opening 46 in the cylinder 29. Following conventional practice when the pin tumblers have been shifted appropriately by a properly cut key to positions where the junction of top and bottom pin tumblers falls at the sheer line, a cylinder plug 40 can be rotated with respect to the cylinder 29, whereas when the key is withdrawn the pin tumblers extending across the shear line block rotation of the cylinder plug.

At the inner end of the cylinder plug is an annular retainer groove 47 in which a reduced portion 48 of a plug retainer pin 49 is adapted to ride, pressed in place by an appropriate spring 50.

A special interconnection between the cylinder plug 40 and an inner tail piece 55 is made use of to cause rotation of the tail piece to appropriately extend and withdraw the locking bolt 18 by key action applied to the inner trim assembly 16. Tail piece 55 of cross-sectional shape corresponding to the outer tail piece 17 extends into a portion 56 of the opening in the hub 20, which, as previously described, is connected by roll-back means (not shown) to the locking bolt 18. Clearly, therefore, the locking bolt can be manipulated from either the outside by a key applied to the outer trim assembly 15 or from the inside by a key applied to the inner trim assembly 16.

Mechanism for interconnecting the cylinder plug 40 to the inner tail piece 55 includes a tail piece drive washer 57 which, in the embodiment shown, is an integral part of the inner tail piece 55. At the periphery of the drive washer is a drive slot 58. The drive washer 57 is rotatably retained in an enlarged portion 59 of the opening 46 by means of a retaining ring 60.

Lying intermediate the drive washer 57 and the inside end of the cylinder plug 40 is a drive pin guide washer 61. There is provided a guide washer return spring 62 for normally pressing the drive pin guide washer 61 endwardly against the inside end of the cylinder plug 40. A spring locator 63 or spring keeper serves to center the guide washer return spring 62 with respect to the other rotating parts.

Extending from the face of the drive pin guide washer 61 which is adjacent the cylinder plug 40 is a guide pin 64, offset with respect to the axis of rotation of the cylinder plug. In the cylinder plug is a washer guide pin hole 65 which slidably receives the guide pin 64.

Diametrically opposite the washer guide pin hole 65 is a drive pin guide recess 66 for accommodation of a drive pin 67 and drive pin spring 68. In the drive pin guide washer 61 is a drive pin guide hole 69 through which a reduced portion 70 of the drive pin 67 is adapted to extend. Around the perimeter of the reduced portion 70 is consequently a shoulder 71 which is adapted to engage the corresponding portion of the drive pin guide washer 61 surrounding the drive pin guide hole 69. When the reduced portion 70 of the drive pin 67 is projected through the drive pin guide hole 69, it is adapted to enter the drive slot 58, in that way to interconnect the inner tail piece 55 with the cylinder plug so that by rotation of the cylinder plug the tail piece is operated.

Figure 3:
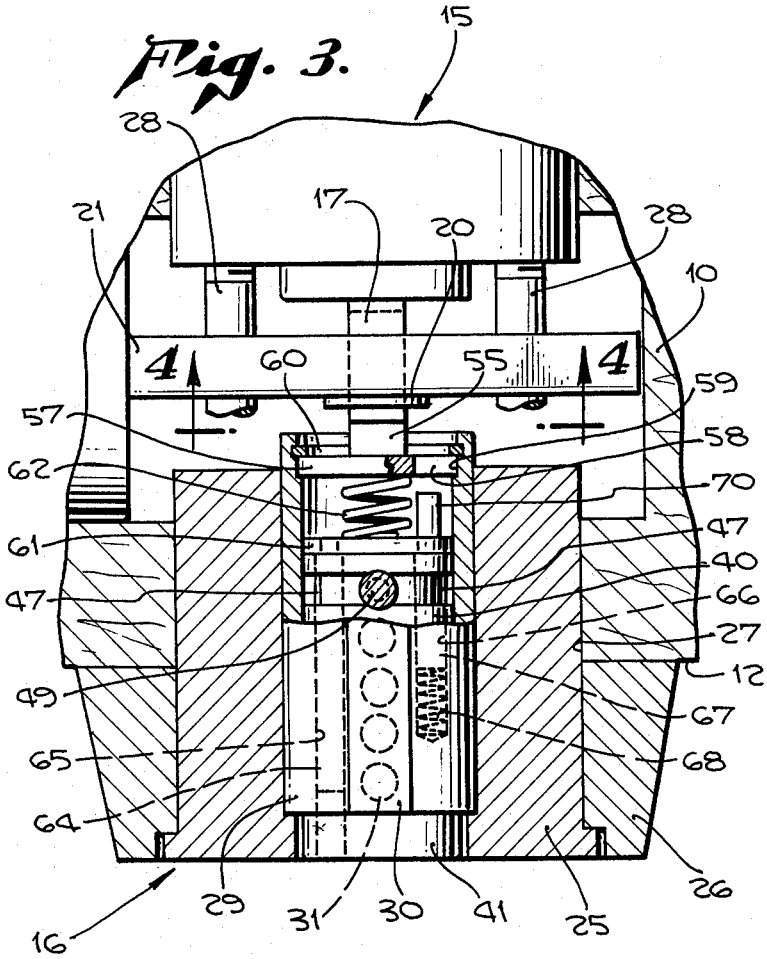
FIG. 3 is a fragmentary sectional view of the inner trim details.
Figure 4:
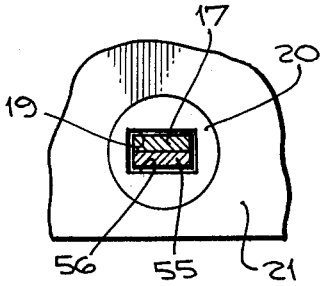
FIG. 4 is a fragmentary cross-sectional view on the line 4—4 of FIG. 3.
Figure 5:
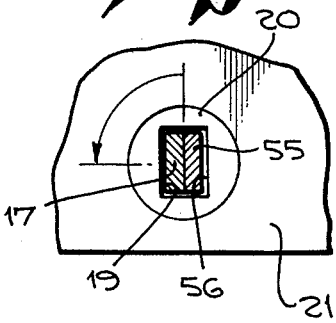
FIG. 5 is a view similar to FIG. 4, but showing tail pieces rotated to locked position 90° removed.
Figure 7:
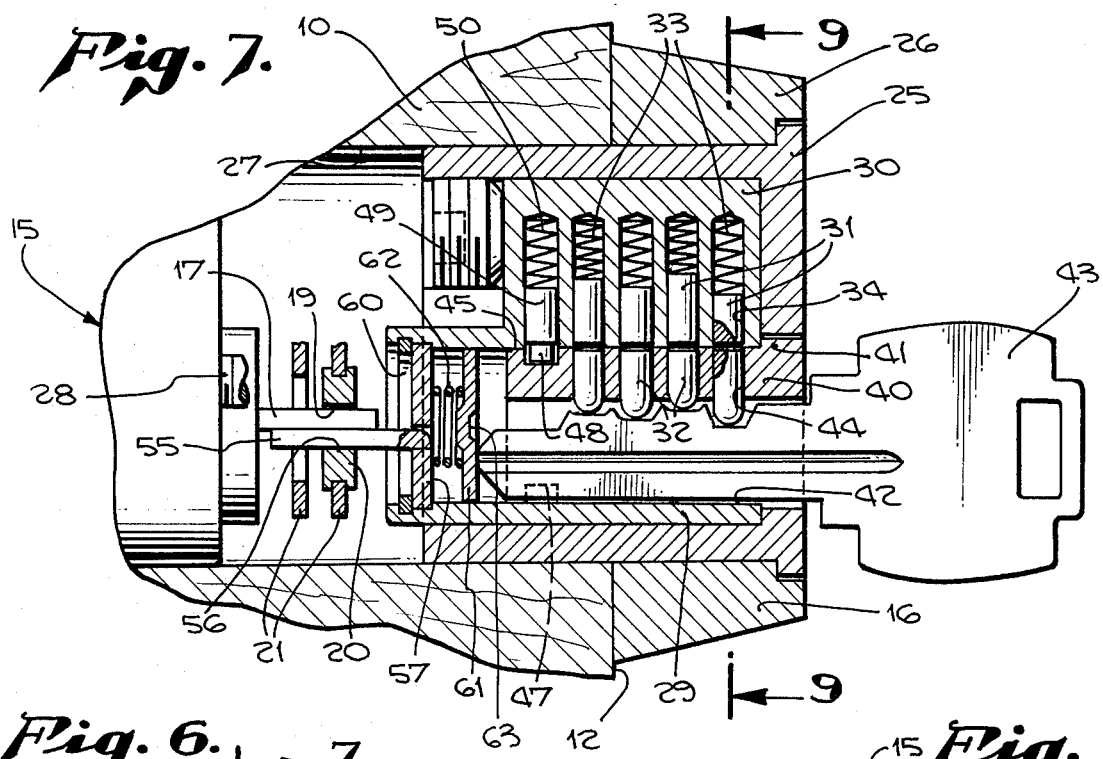
FIG. 7 is a longitudinal sectional view on the line 7—7 of FIG. 6.
Figure 6:
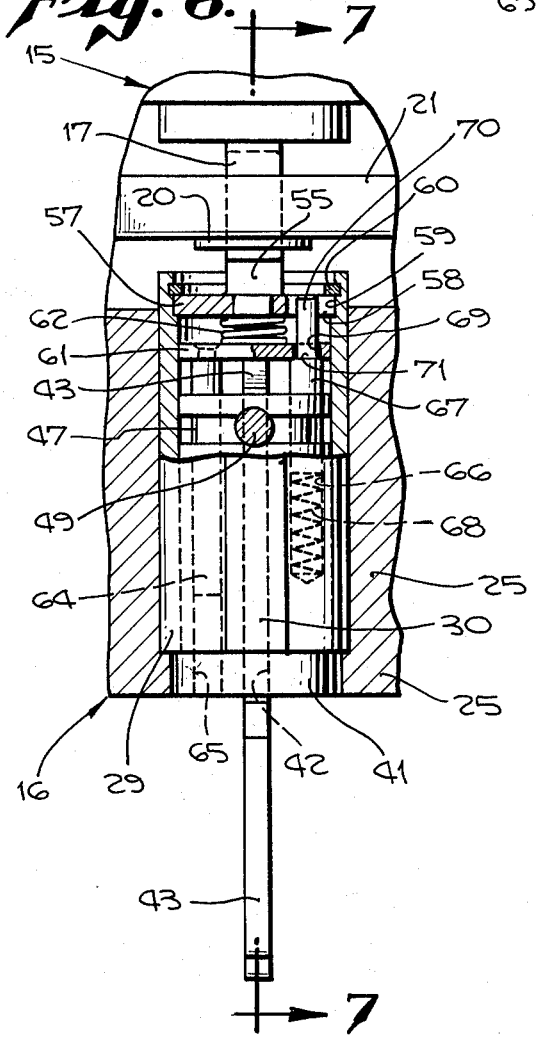
FIG. 6 is a fragmentary sectional view similar to FIG. 3 showing the parts with key inserted.
Figure 8:
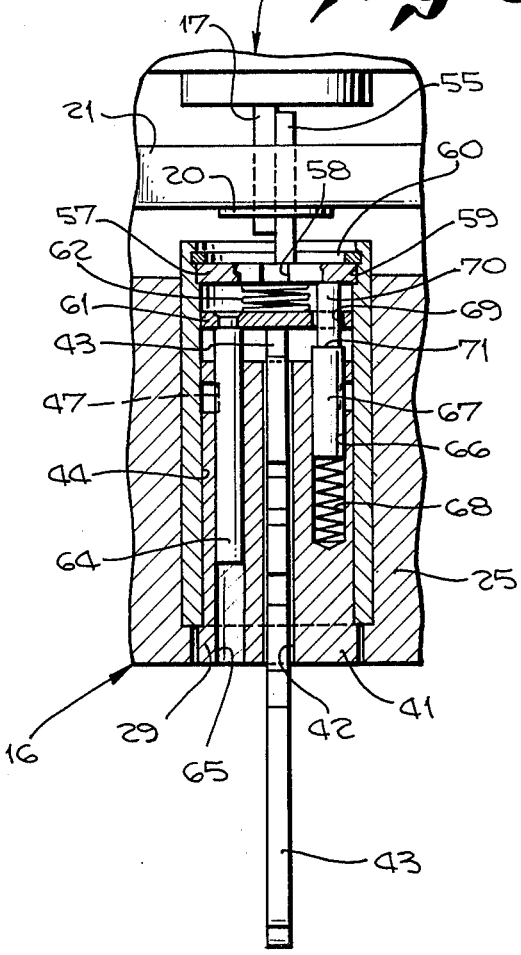
FIG. 8 is a longitudinal sectional view similar to FIG. 6 but with the latch bolt extended by the outer trim.

In operation, let it be assumed that the locking bolt is in withdrawn, namely unlocked, position as shown in FIG. 3 and the occupant wishes to dead-lock the door. The key 43 is accordingly inserted into the keyway 42 of the inner trim assembly 16. The end of the key then pushes endwise against the drive pin guide washer 61, compressing the guide washer return spring 62. At the same time, inasmuch as the drive pin guide hole in initial position is in alignment with the drive slot 58 of the drive washer 57, the reduced portion 70 of the drive pin 67 will be projected into the drive slot 58. Incidentally, as the drive pin guide washer is pushed endwise, the guide pin 64 will slide endwardly within the washer guide pin hole 65 a short distance.

Figures 9, 10, 11:
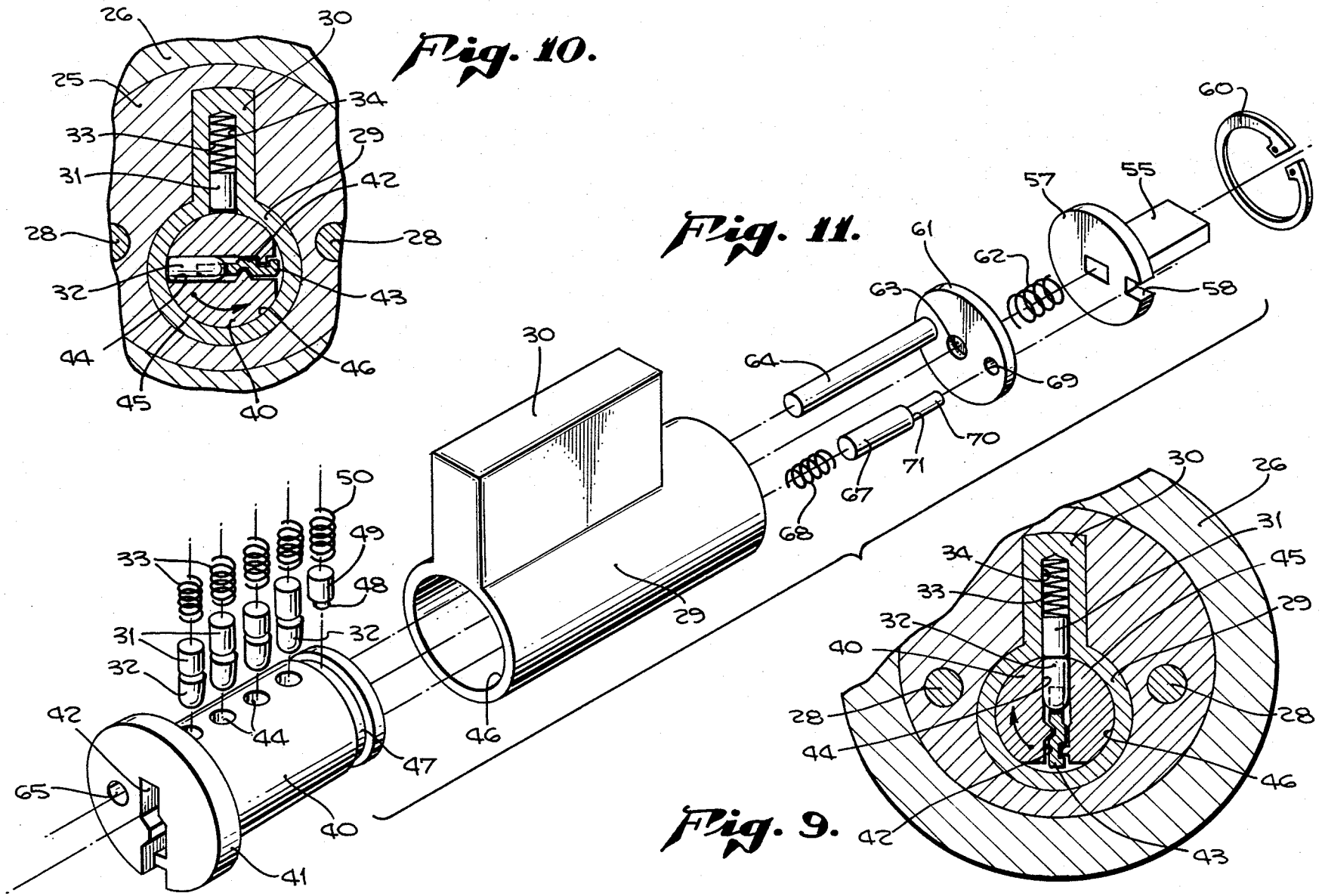
FIG. 9 is a cross-sectional view on the line 9—9 of FIG. 7.
FIG. 10 is a cross-sectional view similar to FIG. 9 but with cylinder parts in dead bolt locked position.
FIG. 11 is a prospective exploded view of the plug, cylinder, and related parts.

From this initial position of the key 43, and with the pin tumblers all being adjusted at the sheer line to permit rotation of the cylinder plug, the key 43 is rotated, counterclockwise as viewed in FIG. 10 causing the locking bolt 18 to be extended into locked position. In that position the bottom pin tumblers 32 having been moved away from the pin tumbler bores 34 housing the top pin tumblers, will be as in FIG. 10 positioned against the inner wall of the opening 46. Accordingly, the key 43 cannot be withdrawn from the key slot because of engagements of the cuts of the key with the lower pin tumblers, now temporarily immovable. This condition prevails for all positions of rotation of the key 43 except rotation back to initial position, which withdraws the locking bolt 18 to unlocked position. As a consequence, the key 43 serves, in effect, as a thumb turn, since it must remain inserted in the keyway as long as the locking bolt is in any position other than unlocked position. In unlocked position, naturally, the key can be withdrawn because the lower pin tumblers are again free to move endwise in the pin tumbler slots.

Even though the key 43 may be left in the keyway of the inner trim assembly, it is always possible to unlock the door from the outside. This is accomplished by employment of a duplicate key which can be applied to the outer trim assembly for rotation of the outer tail piece 17 in the direction needed to withdraw the locking bolt 18. Since this is accompanied by corresponding rotation of the hub 20, the inner tail piece 55 will at the same time be returned to initial position, returning the key 43 in the inner trim assembly also to initial position.

On those occasions where the locking bolt has been extended to locked position by operation of a key in the outer trim assembly 15, it is still readily possible for an occupant on the inside to unlock the lock with an appropriate duplicate key. Under such circumstances the inner tail piece 55 will have been rotated by rotation of the hub 20 in response to operation of the outer trim assembly 15. Rotation is substantially 90° from initial position. As a consequence, the drive slot 58 will also be rotated to a position 90° removed. When a key 43 is then inserted into the keyway 42 the drive pin guide washer 61 is moved against the guide washer return spring 62, depressing the spring, but there will be no drive slot into which the reduced portion 70 of the drive pin 67 can enter. The end of the reduced portion, however, will be pressed against the surface of the tail piece drive washer under tension applied by the drive pin spring 68. The key 43 is then rotated through the 90° arc normally required to extend the locking bolt to locked position. In that rotated position, the drive pin 67 will become aligned with the drive slot 58 and will be driven into engagement with the slot by action of the drive pin spring 68. This having been accomplished, the key 43 can then be return rotated to initial position, thereby to withdraw the locking bolt so that the door can be opened. In this position, when the key 43 is withdrawn, the guide washer return spring then takes over, being rated higher than the drive pin spring 68. The drive pin guide washer 61 is then returned to initial position, causing the reduced portion 70 of the drive pin 67 to be disengaged from the drive slot 58.

I claim:

1. A trapped key mechanism for a security type dead locking bolt provided with a rotatable hub in roll back association with the locking bolt for shifting the locking bolt between extended locked position and retracted posiiton, and an inner key actuated mechanism having an inner tail piece in operative engagement with the hub, said inner key actuated mechanism comprising a cylinder, and a cylinder plug having a keyway therein for reception of a key, said plug being rotatably mounted in the cylinder for key operation between an initial position wherein the locking bolt is withdrawn and positions rotatably removed from initial position wherein the locking bolt is extended, there being a sheer line between said plug and said cylinder with spring actuated tumblers acting between said plug and cylinder across said sheer line, a drive washer for said inner tail piece in axial alignment with the plug and having a drive slot therein, a guide washer intermediate the plug and the drive washer, a spring urged drive pin intermediate the plug and the guide washer and a drive pin guide hole through the guide washer slidably receiving said guide pin and having a position of alignment with the drive slot in said initial position of the keyway, and resilient return means acting between the drive washer and the drive pin guide washer biased to normally urge the drive pin guide washer toward a position effecting disengagement of said drive pin from said drive slot at only said initial position, whereby said key is trapped in said keyway at all positions other than said initial position.

2. A trapped key mechanism as in claim 1 wherein there is an axially slidable guide structure between the plug and the drive pin guide washer.

3. A trapped key mechanism as in claim 1 wherein there is a centering means acting between the plug and the drive pin guide washer.

4. A trapped key mechanism as in claim 1 wherein said drive washer and said inner tail piece comprise an integral subassembly and said drive slot is located in the periphery of said drive washer.

5. A trapped key mechanism as in claim 1 wherein there are holes in the plug offset from the keyway comprising respectively a guide for the drive pin and guide means for the guide structure.

6. A trapped key mechanism as in claim 5 wherein there is a coil spring in the guide hole for the drive pin acting against the drive pin, said coil spring having a lower rate than said resilient return means.

7. A trapped key mechanism as in claim 1 wherein there is an outer key actuated mechanism comprising cylinder and plug with an outer tail piece on the plug in operative engagement with the hub and adapted to move said locking bolt to between extended and retracted positions independently of said inner key actuated mechanism.

8. A trapped key mechanism as in claim 7 wherein there is a sliding surface on the side of said drive washer facing said drive pin and having a sliding contact with said drive pin in all positions except a position of alignment of said drive pin guide hole with said drive slot.

* * * * *